US008950081B2

(12) United States Patent
Heidecker

(10) Patent No.: US 8,950,081 B2
(45) Date of Patent: Feb. 10, 2015

(54) COMPRESSOR DEHYDRATION VIA SORBENT TECHNOLOGY

(75) Inventor: Matthew J. Heidecker, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 233 days.

(21) Appl. No.: 13/523,427

(22) Filed: Jun. 14, 2012

(65) Prior Publication Data

US 2012/0317831 A1 Dec. 20, 2012

Related U.S. Application Data

(60) Provisional application No. 61/498,168, filed on Jun. 17, 2011.

(51) Int. Cl.
*F26B 7/00* (2006.01)
*F26B 5/16* (2006.01)

(52) U.S. Cl.
CPC ..... *F26B 5/16* (2013.01)
USPC ..... 34/381; 34/427; 34/428; 62/192; 62/193; 95/227; 95/231; 96/243; 96/295; 418/55.6; 418/178

(58) Field of Classification Search
USPC ..... 34/380, 381, 427, 428, 497, 520; 62/84, 62/114, 192, 193, 468, 469; 95/227, 231; 96/243, 295; 418/55.2, 55.4, 55.6, 178
See application file for complete search history.

(56) References Cited

U.S. PATENT DOCUMENTS

| | | | | | |
|---|---|---|---|---|---|
| 2,023,435 | A | * | 12/1935 | Peltier et al. | 62/221 |
| 3,803,724 | A | * | 4/1974 | Bombich | 34/80 |
| 4,109,487 | A | * | 8/1978 | Carr | 62/474 |
| 4,329,855 | A | * | 5/1982 | Larsson | 62/473 |
| 4,661,128 | A | * | 4/1987 | Bachhofer et al. | 96/127 |
| 4,862,699 | A | * | 9/1989 | Lounis | 62/84 |
| 4,936,026 | A | * | 6/1990 | Cramer et al. | 34/562 |
| 5,064,356 | A | | 11/1991 | Horn | |
| 5,267,844 | A | | 12/1993 | Grassbaugh et al. | |
| 5,331,747 | A | * | 7/1994 | Stanton | 34/405 |
| 5,423,129 | A | * | 6/1995 | Castle et al. | 34/80 |
| 5,461,883 | A | * | 10/1995 | Terasaki | 62/469 |

(Continued)

FOREIGN PATENT DOCUMENTS

| | | | |
|---|---|---|---|
| JP | 05288156 | A | 11/1993 |
| JP | 07269996 | A | 10/1995 |

(Continued)

OTHER PUBLICATIONS

International Search Report regarding Application No. PCT/US2012/042663, mailed Feb. 19, 2013.

(Continued)

*Primary Examiner* — Steve M Gravini
(74) *Attorney, Agent, or Firm* — Harness, Dickey & Pierce, P.L.C.

(57) ABSTRACT

Methods of removing moisture from a compressor using a sorbent technology are provided. A dehydration device incorporating the sorbent technology is disposed in a system that contains a hygroscopic fluid. By passing the hygroscopic fluid over the sorbent technology, moisture is removed from the hygroscopic fluid. The systems include sealed devices and integral components for heating, ventilation, and air conditioning (HVAC) systems and refrigeration devices.

21 Claims, 4 Drawing Sheets

(56) References Cited

U.S. PATENT DOCUMENTS

| | | | | | |
|---|---|---|---|---|---|
| 5,497,561 | A * | 3/1996 | Murray et al. | 34/80 |
| 5,522,150 | A * | 6/1996 | Schultz | 34/80 |
| 5,592,754 | A * | 1/1997 | Krieder et al. | 34/527 |
| 5,673,493 | A * | 10/1997 | Kazakis et al. | 34/80 |
| 5,689,893 | A * | 11/1997 | Mitsch | 34/80 |
| 5,901,464 | A * | 5/1999 | Kazakis et al. | 34/562 |
| 6,128,825 | A * | 10/2000 | Cunkelman | 34/79 |
| 6,481,222 | B1 | 11/2002 | Denniston | |
| 6,829,844 | B2 * | 12/2004 | Brady et al. | 34/381 |
| 7,100,305 | B2 * | 9/2006 | Hoffman et al. | 34/351 |
| 7,121,016 | B2 * | 10/2006 | Burn et al. | 34/330 |
| 7,179,069 | B2 | 2/2007 | Grassbaugh | |
| 7,185,447 | B2 * | 3/2007 | Arbeiter | 34/471 |
| 7,326,277 | B1 | 2/2008 | Cohen et al. | |
| 7,413,423 | B2 | 8/2008 | Bonifas | |
| 7,647,790 | B2 | 1/2010 | Ignatiev et al. | |
| 2006/0105158 | A1 | 5/2006 | Fritz et al. | |
| 2012/0030960 | A1 * | 2/2012 | Ryoo et al. | 34/86 |

FOREIGN PATENT DOCUMENTS

| | | | |
|---|---|---|---|
| JP | 08075322 | A | 3/1996 |
| JP | 10103816 | A | 4/1998 |

OTHER PUBLICATIONS

Written Opinion of the International Searching Authority regarding Application No. PCT/US2012/042663, mailed Feb. 19, 2013.

"Desiccant Chart Comparisons," Sorbent Systems, available at http://www.sorbentsystems.com/desiccants_charts.html (downloaded on Jul. 7, 2014).

Echin, A.I., et al., "Hygroscopicity of synthetic oils," Chemistry and Technology of Fuels and Oils, vol. 17, No. 4, pp. 198-200 (Apr. 1981).

International Preliminary Report on Patentability mailed on Dec. 17, 2013 for PCT International App. No. PCT/US2012/042663 (Pub. No. WO 2012/174374).

* cited by examiner

COMPRESSOR DEHYDRATION VIA SORBENT TECHNOLOGY

CROSS-REFERENCE TO RELATED APPLICATIONS

This application claims the benefit of U.S. Provisional Application No. 61/498,168, filed on Jun. 17, 2011. The entire disclosure of the above application is incorporated herein by reference.

FIELD

The present disclosure relates to compressors and, more particularly, dehydration of a compressor using sorbent technologies.

BACKGROUND

The statements in this section merely provide background information related to the present disclosure and may not constitute prior art.

Various devices like compressors, pumps, engines, or expanders may be used to displace fluids in a system. Certain compressors, such as scroll compressors, may be sealed from external gases and air. An exemplary sealing is a hermetic or semi-hermetic sealing of the compressor. However, once sealed, the repair or maintenance options are limited. In certain aspects, the device may be pretreated to facilitate proper operation. An exemplary pre-treatment before hermetically sealing the device includes oven-drying the compressor for a prolonged duration of time followed by evacuation to remove residual moisture because such residual moisture may lead to acid formation and/or degradation of the lubricants and refrigerant system used in the compressor. The drying process is time and energy intensive, requires expensive capital equipment and maintenance, and accounts for a non-negligible portion of the costs of the final compressor. The cumbersome drying process and financial burden are tolerated, however, to mitigate the impact of moisture on the ultimate operation of the hermetically sealed compressor and to allow time efficient drawdown and refrigerant charge at the end user.

Despite the pre-treatment drying efforts, residual moisture may exist in the internal components within the compressor and the lubricant, and considering that some lubricant systems can be hygroscopic, the present moisture may have an affinity for the lubricant. As such, the sealed environment of the compressor processing lubricants and/or refrigerants poses challenges to maintaining a dry system.

SUMMARY

Further areas of applicability will become apparent from the description provided herein. It should be understood that the description and specific examples are intended for purposes of illustration only and are not intended to limit the scope of the present disclosure.

In various aspects, the present teachings provide methods of removing moisture in a sealed system. In certain variations, the sealed system is a compressor. A hygroscopic fluid is introduced into the sealed system. The hygroscopic fluid is contacted with a dehydration device located on an interior of the sealed system to remove a portion of moisture from the sealed system.

In certain aspects, a method of removing moisture in a sealed system comprising a compressor comprises first introducing a fluid into the sealed system comprising the compressor. Then, the fluid is contacted with a dehydration device located inside or disposed near the compressor in the sealed system to remove a portion of moisture from the sealed system.

In further aspects, the present teachings provide methods of removing moisture from a scroll compressor capable of circulating a fluid. A dehydration device in the form of a permeable vessel comprising a plurality of dehydration components is disposed within the compressor. After introducing the fluid in the compressor, the permeable vessel contacts the fluid and removes at least a portion of moisture contained in the fluid by retaining the moisture in the dehydration components.

In other aspects, the present teachings provide methods of forming a compressor. A dehydration device is disposed on an interior of a compressor that is sealed. The dehydration device is capable of removing at least a portion of moisture from a hygroscopic fluid circulated within the compressor.

In still further aspects, the present teachings provide methods of forming a component for a scroll compressor. A composite material formed from a polymer matrix and a sorbent material is shaped into an integral component for a scroll compressor.

DRAWINGS

The drawings described herein are for illustration purposes only and are not intended to limit the scope of the present disclosure in any way.

DETAILED DESCRIPTION

Figure 1:
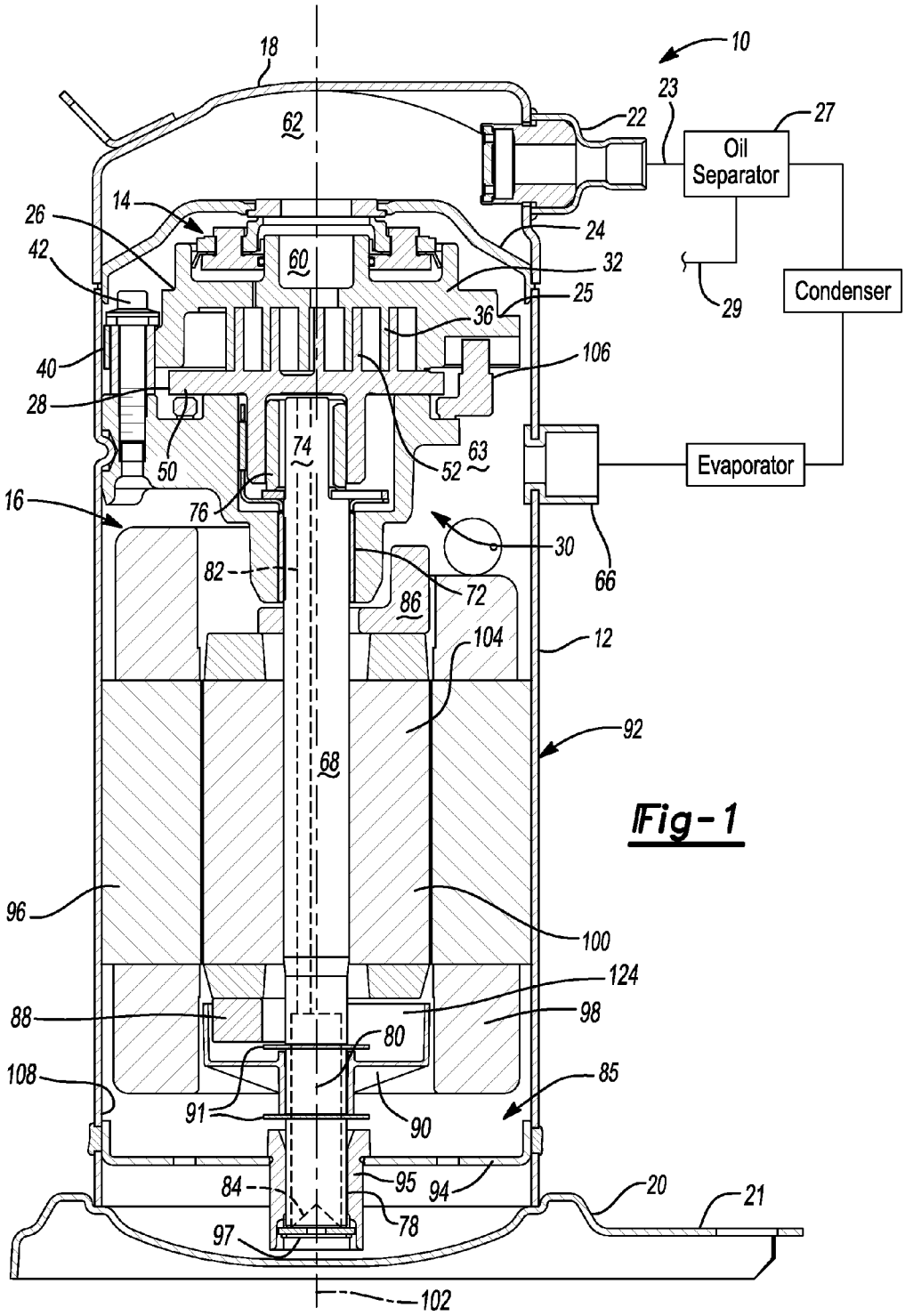
FIG. 1 is a cross-sectional view of a scroll machine according to various embodiments of the present teachings.

The following description is merely exemplary in nature and is not intended to limit the present disclosure, application, or uses. It should be understood that throughout the drawings, corresponding reference numerals indicate like or corresponding parts and features.

The present teachings relate to moisture control using sorbent technologies to facilitate ongoing, long-term dehydration in a sealed device, such as a compressor. An exemplary compressor is a scroll compressor 10 as depicted in FIG. 1. While the scroll compressor 10 is used as the primary example in the present disclosure, it is understood that these teachings are applicable to other types of compressors (e.g., reciprocating compressors). Further, the principles of the present disclosure also pertain to other mechanical or electromechanical devices, including engines, pumps, and devices related to heating, ventilation, and air conditioning (HVAC) systems and refrigeration systems. For clarity, a description of the scroll compressor 10 is provided first, followed by details on the materials and techniques used to provide the moisture control.

Scroll Machines

With reference to FIG. 1, the scroll machine 10 includes a shell 12, a compressor section 14, and a motor-drive section 16. The shell 12 facilitates generally sealing or hermetically sealing the device so that it is impervious to gases. As used herein, the term hermetically sealing includes sealing the shell in any manner including closing the shell using a weld (typically called a full hermetic seal) or closing the shell using a fastener and/or seal or gasket (typically called a semi-hermetic seal). The shell 12 may be generally cylindrical in shape as shown. The shell 12 includes a cap 18 welded at the upper end thereof and a base 20 welded at the lower end thereof. The cap 18 may include a refrigerant-discharge fitting 22, which may have a discharge valve therein (not shown). The shell 12 also includes a suction inlet fitting 66 to create a suction chamber 63. The base 20 may include a plurality of mounting feet 21 integrally formed therewith. The shell 12 may further include a transversely extending partition 24 that may be welded about its periphery at the same point that the cap 18 is welded to the shell 12.

The compressor section 14 may include a compression mechanism 25, a non-orbiting scroll member 26, an orbiting scroll member 28, and a bearing housing 30. The non-orbiting scroll member 26 may include an end plate 32 having a spiral wrap 36 extending therefrom. The non-orbiting scroll member 26 may be secured to the bearing housing 30 and may include a plurality of embossments 40 that attach the non-orbiting scroll member 26 to the bearing housing 30 by a plurality of bolts 42.

The orbiting scroll member 28 may include an end plate 50 and a spiral wrap 52 that extends upright from the end plate 50. The spiral wrap 52 may be meshed with the spiral wrap 36 of the non-orbiting scroll member 26 to form compression chambers 54 that may fluidly communicate with a discharge port 60. The discharge port 60 may communicate with a discharge chamber 62 that may be formed by the partition 24 and the cap 18.

The motor-drive section 16 may include a drive member such as a crankshaft 68 coupled to the orbiting scroll member 28 to drive the compression mechanism. The crankshaft 68 may be rotatably journaled in a bearing 72 in the bearing housing 30 and may include an eccentric shaft portion 74. The eccentric shaft portion 74 may be coupled to the orbiting scroll member 28 through a drive bushing and bearing assembly 76. The crankshaft 68 may be supported by the motor-drive section 16 at a lower end thereof, whereby the lower end of the crankshaft 68 includes a concentric shaft portion 78.

Figure 2:
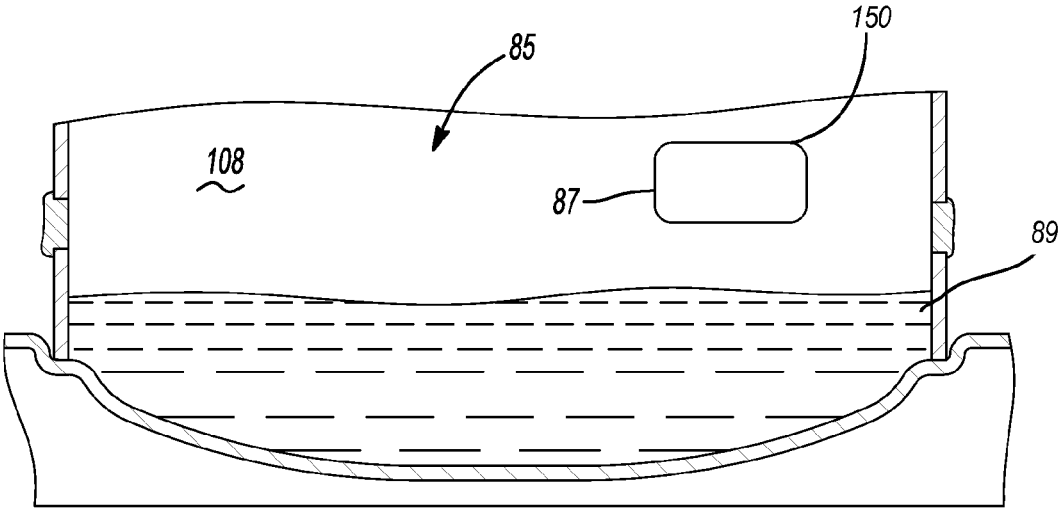
FIG. 2 is a partial view of a sump according to various embodiments of the present teachings.

The lower end of the crankshaft 68 may include a concentric bore 80 that communicates with a radially inclined bore 82 extending upwardly therefrom to the top of the crankshaft 68. A lubricant flinger 84 may be disposed within the bore 80 to pump fluid disposed in a sump 85 or lower end of the shell (e.g., within the base 20) through the bores 80, 82 to the compressor section 14 and other portions of the scroll machine 10 requiring lubrication. The lubricant flinger 84 may be of the type disclosed in commonly owned U.S. Pat. No. 7,179,069, the disclosure of which is incorporated herein by reference. With reference to FIG. 2, the sump 85 serves a fluid collection area and may also include a single or multiple attachment points 87 at which to fix the dehydration devices 150 (as shown in certain variations in FIGS. 3-6B) of the present teachings, as will be detailed later herein.

Figure 5:
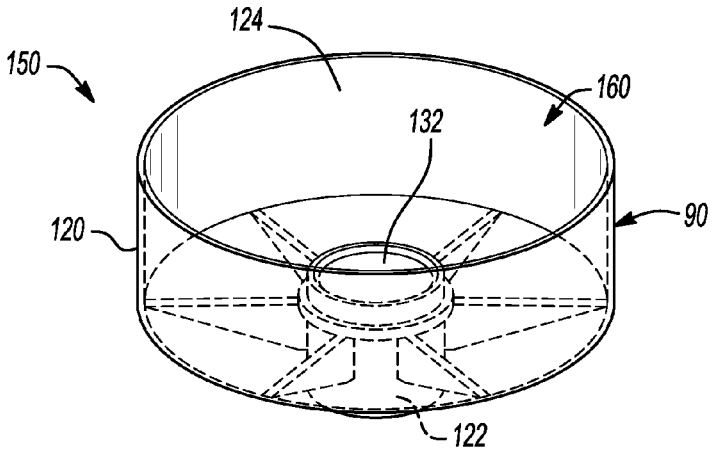
FIG. 5 depicts a counterweight cover according to various embodiments of the present teachings.

Returning to FIG. 1, upper and lower counterweights 86, 88 may be attached to the crankshaft 68 and/or a rotor 100. Additionally, a counterweight cover 90 may also be provided to reduce the work loss caused by the lower counterweight 88 coming in contact with lubricant disposed within the shell 12. The counterweight cover 90 may be of the type disclosed in commonly owned U.S. Pat. Nos. 5,064,356 and 7,413,423, the disclosures of which are incorporated herein by reference. As best shown in FIG. 5, the cover 90 includes an upper portion 120 that is generally formed in the shape of a cup with a generally circular periphery, a lower portion 122 that is generally in the shape of a cup with a generally radial periphery. The cover 90 defines an interior void volume 124 and a central opening 132.

Returning to FIG. 1, the motor-drive section 16 may further include a motor assembly 92 and a lower bearing support member 94. The motor assembly 92 may be securely mounted in the shell 12 and may include a stator 96, windings 98, and the rotor 100. The stator 96 may be press fit in the shell 12, while the rotor 100 may be press fit on the crankshaft 68. The stator 96, windings 98, and rotor 100 may work together to drive the crankshaft 68 and thereby cause the orbiting scroll member 28 to orbit relative to the non-orbiting scroll member 26 when the motor assembly 92 is energized.

The support member 94 may be attached to the shell 12 and have a lower bearing 95 attached thereto. The lower bearing 95 may rotatably support the crankshaft 68. To this end, the support member 94 and/or lower bearing 95 may work together with the bearing housing 30 to define a vertical axis 102 about which the crankshaft 68 rotates. The lower bearing 95 may also include a thrust washer 97 to axially support the crankshaft 68 by providing support in the vertical direction along vertical axis 102. Additionally, the thrust washer 97 may be used to inhibit vertical movement of the crankshaft 68 in a downward direction generally toward the base 20. In the foregoing manner, the support member 94 and/or lower bearing 95 also may work together with the bearing housing 30 to define a motor air gap 104 between the stator 96 and the rotor 100.

The support member 94 may be attached to the shell 12 in any suitable manner. For example, the support member 94 may be staked to the shell in a manner similar to that described in commonly owned U.S. Pat. No. 5,267,844, the disclosure of which is incorporated herein by reference. Alternatively or additionally, the support member 94 may be attached to the shell 12 using a weld joint or a plurality of fasteners (not shown).

Materials and Methods

In one aspect, the present teachings provide methods to remove at least a portion of residual moisture from hygroscopic fluids using sorbent technologies. Generally, hygroscopic fluids include fluids that attract and absorb or adsorb moisture from a surrounding environment. Residual moisture or the moisture from the surrounding environment as detailed herein includes water, water vapor, polar components, acids, and moisture present in or from the working fluid of the compressor. Residual moisture in a hygroscopic fluid would cause the hygroscopic fluid to have a moisture content that exceeds a starting moisture content of an unmodified or processed hygroscopic fluid. It is believed that properties of a starting hygroscopic fluid may change after exposure to moisture in a surrounding environment because after the absorption or adsorption of moisture, the water molecules are suspended between molecules of the hygroscopic fluid. In select environments, moisture absorption or adsorption is to be minimized to prevent impact on the viscosity, miscibility, thermal stability, and other physical and/or chemical characteristics of the starting hygroscopic fluid.

Exemplary fluids that are introduced into scroll compressors 10 include lubricants and refrigerants. In the present teachings, the fluids are introduced using different techniques, including "charging" the scroll compressors 10 as will be detailed later herein. Refrigerants include without limitation those generally classified as halocarbons, including fluorocarbons, hydrofluorocarbons, hydrochlorofluorocarbons, and hydrofluoro-olefins; hydrocarbons; and natural refrigerants such as carbon dioxide and ammonia, and combinations thereof. Lubricants include, by way of example, those classified as naphthenic refrigeration oils, alkylbenzenes, polyalkene glycols, polyalkylene glycols, polyol esters (POE), diesters, dimer esters, aromatic esters, monoesters, polyalphaolefins, mineral oils, and various other synthetic oils and blended oils, and combinations thereof. Examples of hygroscopic fluids include polyol esters (POE), diesters, dimer esters, aromatic esters, monoesters, polyalkylene glycols and polyalkene glycols. Other suitable hygroscopic synthetic oils are detailed in "Hygroscopicity of Synthetic Oils" by A. I. Echin, et al., Chemistry and Technology of Fuels and Oils, Vol. 17, No. 4, pp. 198-200 (1981), which is incorporated herein by reference.

As stated above, residual moisture or unwanted moisture in a hermetically or otherwise sealed environment may reduce the longevity and/or performance of the device. For example, in the scroll compressor 10, residual moisture accumulation in the lubricant is believed to decrease the lubrication in the system while increasing the acid content and potentially the surface degradation of the components of the device. Because the scroll compressors 10 can be hermetically sealed in certain variations, moisture in the scroll compressor 10 in such a design will likely remain for the life of the scroll compressor 10.

With reference to FIGS. 3-6B, various exemplary dehydration devices 150 used in the present methods of removing moisture during the life of the scroll compressor 10 are provided. The methods and devices detailed herein remove at least a portion of residual moisture in the hygroscopic fluid. The moisture removal may be quantified as a reduction in water concentration in parts per million or alternatively as a weight percentage reduction. For example, with polyol ester oils, an exemplary starting moisture content is approximately 350 parts per million at the time of charge, prior to the aforementioned dehydration process. In certain aspects, the methods of the present teachings reduce the moisture content to a value closer to the initial moisture content of the hygroscopic fluid of less than or equal to about 350 parts per million (ppm), optionally less than or equal to about 300 ppm, optionally less than or equal to about 200 ppm. Thus, in certain aspects, a comparative hygroscopic fluid having the same composition, but processed in a comparative compressor (lacking the inventive dehydration device(s) 150) has a significantly greater moisture content than a hygroscopic fluid treated in accordance with the present teachings to reduce moisture content. In certain embodiments, the moisture content after treatment of the hygroscopic fluid according to the present methods is greater than or equal to about 5% to less than or equal to about 99% less than a previous moisture content in the hygroscopic fluid prior to treatment according to the present methods, including all sub-ranges therebetween.

In certain aspects, the dehydration devices 150 are made of a polymer composite including a molecular sieve material in a polymer matrix. The molecular sieve is a zeolite type material, with a controlled pore size of 3 to 4 Angstrom which in turn excludes larger molecules from being absorbed/adsorbed as system refrigerants are generally above this threshold. For example, R22—a common HCFC—has an effective molar diameter of 4.79 Angstrom while R134a, R32, and R143a—common HFCs—have respective molar diameters of 5.24 Angstrom, 4.43 Angstrom, and 5.14 Angstrom. Helium, when used as a refrigerant, is below the absorption/adsorption threshold, rendering the system less effective as the effective molar diameter of helium is 0.49 Angstrom. Water readily absorbs/adsorbs into the zeolite type molecular sieve as water is generally regarded as having a diameter of 1.93 Angstrom. The sorbent system will draw free moisture from within the system and also moisture contained within the lubricant into the molecular sieve, trapping the water molecule and substantially preventing it from escaping. In various aspects, the composite material has a higher affinity for water as compared to the affinity of the hygroscopic fluid for water so residual moisture is permanently removed from the hygroscopic fluid, thus eliminating potential changes in the hygroscopic fluid due to residual moisture retention.

In certain aspects, the methods of the present teachings are capable of providing long-term moisture removal, which can last up to ten years or longer allowing moisture removal after devices are hermetically sealed. For example, the long-term moisture removal capability of the present technology can last a duration of greater than or equal to about six months, optionally greater than or equal to one year, optionally greater than or equal to two years, optionally greater than or equal to three years, optionally greater than or equal to five years, optionally greater than or equal to eight years, and in certain aspects, optionally greater than or equal to ten years, including all sub-ranges. Similarly, long-term moisture removal can be quantified in periods of thousands of working hours, as is sometimes used to describe the life of certain devices like compressors. Thus, long-term moisture removal capabilities of the present technology can last for greater than or equal to about 1,000 working hours, optionally greater than or equal to about 2,000 working hours, optionally greater than or equal to about 3,000 working hours, optionally greater than or equal to about 5,000 working hours, optionally greater than or equal to about 7,000 working hours, optionally greater than or equal to about 10,000 working hours. In accordance with certain aspects of the present teachings, an initial sharp drop in the residual moisture content occurs followed by a slightly decreased level of moisture removal over the long-term of moisture removal. This is due to the sorbent material retaining moisture initially present in the system followed by retention of residual moisture subsequently generated in the system. It is also related to permeability characteristics and the design of the integral component itself.

The long-term moisture removal is beneficial in that moisture removal is not conducted solely during an oven drying process prior to hermetic sealing. Instead, the moisture removal provided by the present technology is ongoing after charging the device with the hygroscopic fluid and is ongoing during operation of the device, especially when it is a hermetically sealed device, including in active fluid displacement operational mode, a stand-by operational mode, and/or in an off or non-operational condition. In certain embodiments, the moisture removal from the dehydration device 150 is the first moisture removal within the hermetically sealed device (i.e., the hermetically sealed device is not oven dried or otherwise dried prior to the hermetic sealing). In such embodiments, the cost of the oven and its maintenance can be eliminated because the initial drying is achieved after the device is charged with a fluid. This initial drying and the ongoing, long-term drying from the inventive technology addresses the challenges of controlling moisture in hermetically sealed devices and diminishes the issues associated with limited repair opportunities and maintenance options after hermetic sealing.

The composite includes a suitable polymer (e.g., polymer matrix) that is compatible with the sorbent material. Exemplary polymers include polyamides, polypropylene, polyethylene, polyetheretherketone, polyesters, polyvinyl chloride resins, vinyl acetate resins, acrylic resins, acetal resins, and the like, as well as combinations thereof. Suitable thermoplastics further include those broadly classified as amorphous or semi-crystalline. As will be discussed below, in certain embodiments, suitable polymers include those that have adequate physical characteristics to form an integral component or working component of the scroll compressor 10. In certain aspects, working components are non-structural (e.g., not mechanical) parts of the compressor 10. By way of example, an integral working component may be suction baffles, suction mufflers, wire guides, a counterweight cover 90, and other parts as depicted in FIG. 1, as non-limiting examples. Likewise, the material in certain aspects must also possess sufficient chemical resistance to the lubricant and refrigerant of the system, rendering amorphous materials as non-optimal for hermetic scroll type compressors.

The sorbent material in the composite includes zeolites such as calcium zeolites, sodium zeolites, potassium zeolites, and combinations thereof as the materials have superb water affinity and retention. Suitable sorbent materials also include aluminosilicates, including aluminosilicate, calcium aluminosilicate, sodium aluminosilicate, and combinations thereof. In various embodiments, the particle size of the sorbent material is selected for compatibility with the polymer matrix and/or for the parameters of the component formed from the composite material. The sorbent materials are provided as a single composition, or a blend of different sorbent materials and/or sizes may be incorporated into the polymer matrix.

In various embodiments, the composite material includes greater than or equal to about 5% to less than or equal to about 85% of the sorbent material by weight, including all subranges. In various embodiments, the relative water affinity of the hygroscopic fluid and the composite material is controlled by increasing or decreasing the weight percentage of the sorbent material in the composite. Also, the distribution of the sorbent material within the polymer matrix can also be manipulated to provide a gradient of the sorbent material or discrete regions of sorbent material distributed in the dehydration device 150. It is understood that the composite material may be solid or it may include interstices or spaces between the sorbent and polymer matrix to provide a contact surface or a flow path for moisture removal from the hygroscopic fluid.

The composite may be formed by conventional processing techniques such as injection molding, compression molding, extrusion, and the like, as non-limiting examples. Additionally, one of skill in the art appreciates that additional additives can be employed, including, but not limited to, pigments, various stabilizers, plasticizers, wax, antioxidants, and the like.

Figure 7:
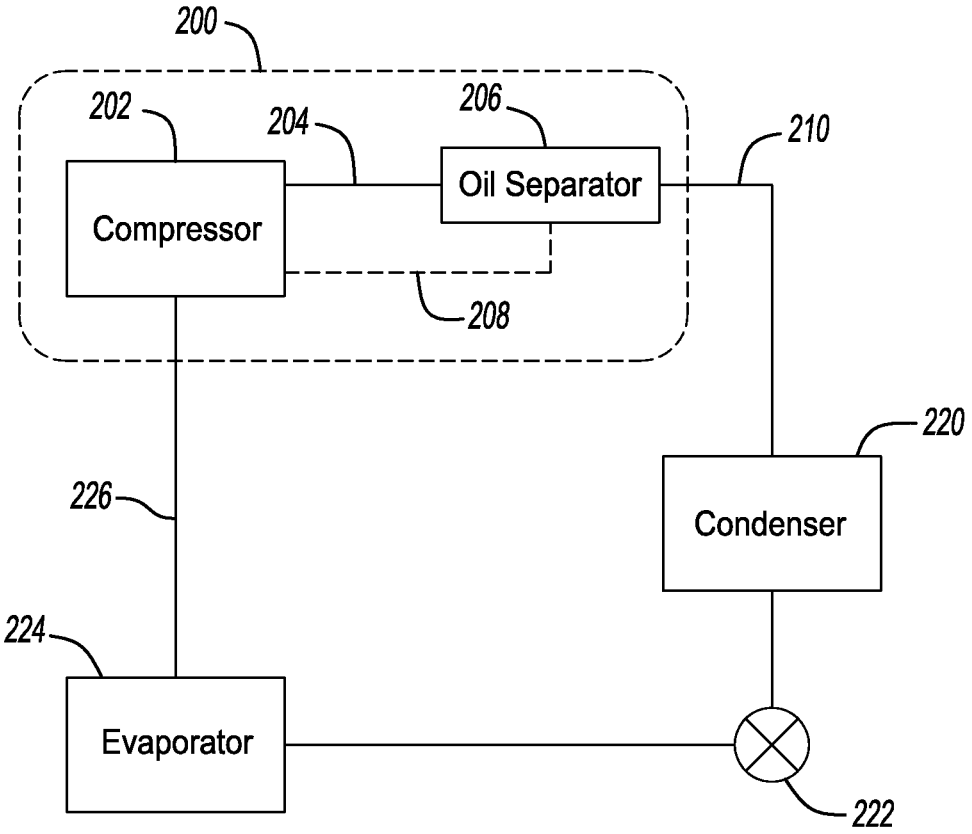
FIG. 7 is a simplified exemplary schematic of a refrigeration system.

In certain embodiments, the dehydration device 150 is placed at a location inside the scroll compressor 10 or at a location within a sealed refrigeration system near or in proximity to the scroll compressor 10. In general, a sealed system involving compression refrigeration cycle, includes a compressor, a condenser, an expansion valve and an evaporator in a closed or hermetically sealed system, in which is circulated a fluid comprising a refrigerant and in certain regions, a refrigerant and lubricating oil. By way of example, FIG. 7 shows an exemplary simplified sealed system (e.g., a refrigeration circuit) that comprises a compressor region 200. The compressor region 200 of the sealed refrigeration system includes the compressor 202 and an oil separator 206 in fluid communication with the compressor 202. A first fluid conduit 204 provides fluid communication between the compressor 202 and oil separator 206. The oil separator 206 serves to remove any residual oil combined with the refrigerant (hygroscopic fluid) after it exits the compressor 202. As shown in FIG. 7, a second conduit 208 is shown to recycle oil from the oil separator 206 and re-introduce it into the compressor 202. However, other configurations are also contemplated, such as where the discharge from the oil separator 206 may be removed from the system altogether.

A third conduit 210 provides fluid communication between the oil separator 206 and the condenser 220. The third conduit 210 thus serves to transport refrigerant to the condenser 220. The sealed system also comprises an expansion valve 222 and an evaporator 224 for processing the refrigerant. The refrigerant is returned from the evaporator 224 to the compressor 202 via a fourth conduit 226. In certain embodiments, the dehydration device 150 is placed at a location that facilitates contact with the hygroscopic fluid. Such a location is within the compressor region 200, which may be inside the compressor 202 itself or alternatively at a location in near proximity to the compressor 202, for example, in the first conduit 204 or within the oil separator 206.

Figure 3:
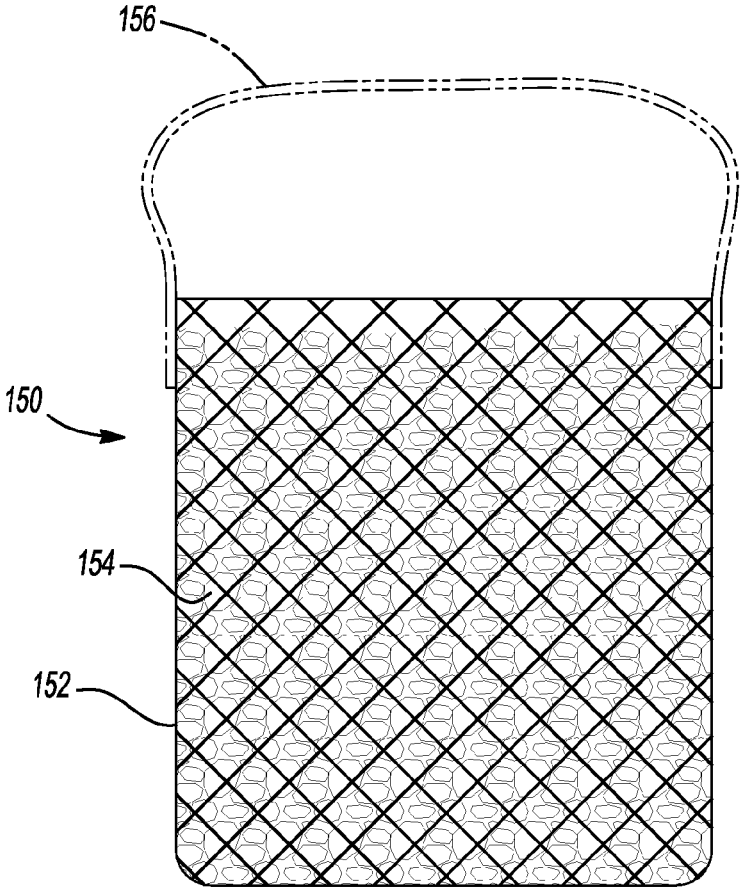
FIG. 3 depicts a dehydration device according to various embodiments of the present teachings.

With renewed reference to FIGS. 1-3, the dehydration device 150 is desirably located inside the scroll compressor 10 at a location that facilitates contact with the hygroscopic fluid. The scroll compressor 10 is shown to be generally part of a sealed system that includes an oil separator 27, a condenser, and an evaporator. The fluid conduit 23 leading to oil separator 27 and the oil separator return conduit 29 are also shown. The hermetically sealed system is charged with a hygroscopic fluid which is then contacted with the dehydration device 150 located on an interior 108 of the hermetically sealed system to remove a portion of moisture. Charging includes introducing a refrigerant and/or an oil component into the scroll compressor 10. Charging, which includes recharging, can occur after the scroll compressor 10 is created, after the hermetic sealing, after incorporation of the scroll compressor 10 into a larger system, after testing or part validation, after a repair, or at any other point of the life of the scroll compressor 10, as non-limiting examples. Contacting the hygroscopic fluid with the dehydration device 150 can occur concurrently with the charging of the scroll compressor 10 with the hygroscopic fluid.

Particularly, as shown in FIG. 2, a generic attachment point 87 for the dehydration device 150 is on a wall 108 near the sump 85 of the scroll compressor 10 where the dehydration device 150 contacts circulating hygroscopic fluids 89. This places the dehydration device 150 where a vast majority of hygroscopic fluid resides during the off-cycle of the compressor. Further, this placement facilitates exposure of large amounts of the hygroscopic fluid to the dehydration device when it is flowing or otherwise transitioning during an on- (or active fluid displacement), off-, and/or a standby mode. As noted above, in alternative embodiments, while not shown, a dehydration device may be disposed near, but outside of the compressor, for example in the fluid conduit 23 or the oil separator 27 where the dehydration device can contact hygroscopic fluid in the sealed system.

Turning to FIG. 3, in one embodiment the dehydration device 150 is depicted as a permeable vessel 152 having a plurality of dehydration components 154 therein. After charging the scroll compressor 10 with a hygroscopic fluid, the permeable vessel 152 housing the plurality of dehydration components 154 contacts the hygroscopic fluid and retains or removes at least a portion of moisture contained in the hygroscopic fluid by retaining the moisture in the dehydration components 154.

In embodiments where the vessel is two-sided to form a stand-alone packet, the permeable vessel 152 is attached in the scroll compressor 10 using the lanyard 156 (shown in phantom), or the permeable vessel 152 includes another fastening element such as a magnet, hook, rivet, and the like (not shown). In other embodiments, the permeable vessel 152 is formed by securing the dehydration components 154 between an interior wall 108 of the scroll compressor 10 and a sheet of mesh secured to the interior wall 108 about the dehydration components 154. In certain variations, the permeable vessel 152 is a mesh bag or packet. The permeable vessel 152 in the form of a mesh bag or packet may be strapped to a bracket attached to a portion of the compressor 10. Alternatively, the permeable vessel 152 in the form of a mesh bag or packet comprises a magnet that may provide attachment to a portion of the compressor 10. In yet another variation, the permeable vessel 152 in the form of a mesh bag or packet is magnetized to provide attachment to one or more regions of the compressor 10.

The opening size of the mesh is selected to retain the dehydration components 154 and also allow the hygroscopic fluid to flow through the mesh and also flow freely over and between interstices between the dehydration components 154 and where applicable to flow within voids defined by the dehydration components 154. These size accommodations facilitate passage of the hygroscopic fluid so that the sorbent materials trap the residual moisture without hindering fluid supply to the scroll compressor 10. As depicted, a plurality of different size dehydration components 154 having irregular shapes are employed in the permeable vessel 152. It is understood that different or similar size dehydration components 154, and dehydration components 154 having varying water affinities can be combined in a permeable vessel 152.

Figure 4A:
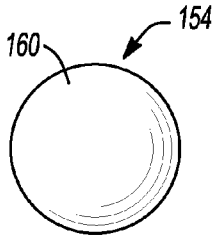
FIGS. 4A-4B depict various shapes of composite materials according to various embodiments of the present teachings.
Figure 4B:
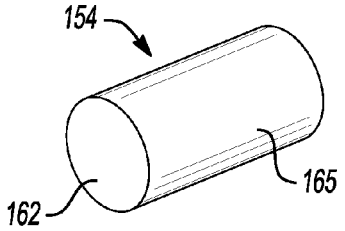

Turning to FIGS. 4A-4B, various other shapes are shown for the dehydration components 154. As shown in FIG. 4A, the dehydration component 154 is a sphere 160. As shown in FIG. 4B, the dehydration component 154 is a generally straight tube 162 shown as a solid cylinder 165. Regular, irregular, hollow, solid, porous, and semi-porous dehydration components 154 are within the scope of the present teachings. The shapes can be selected to maximize surface area of the composite material, for example, by using a hollow system, or by optimizing the diameter of the dehydration component 154 selected. By maximizing surface area, the exposure of the hygroscopic fluid to the dehydrating effects of the composite are also maximized.

Turning to FIG. 5, the dehydration device 150 is illustrated as a counterweight cover 90 as detailed above. The counterweight cover 90 is an exemplary integral component or working component for the compressor 10. As used herein, an integral component includes a part of the compressor 10 that facilitates its operation or placement in a system, such as those depicted in FIG. 1. In such an embodiment, the composite material is formed into the shape of the counterweight cup by molding, for example injection molding. In such embodiments, the counterweight cover 90 is secured to the scroll compressor 10 by traditional securing methods, such as using e-clips 91.

Figure 6A:
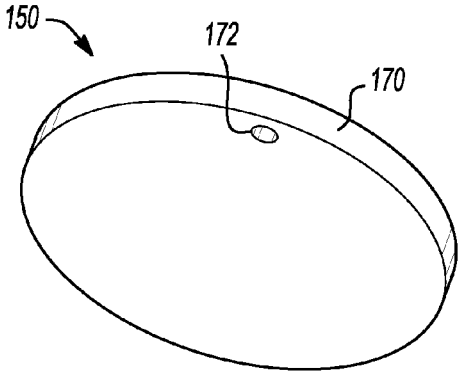
FIGS. 6A-6B depict an active package and an exemplary mounting feature according to various embodiments of the present teachings.
Figure 6B:
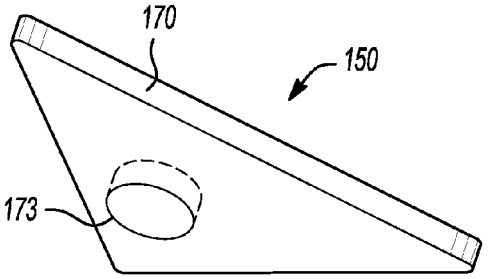

Turning to FIGS. 6A-6B, the dehydration device 150 is depicted as a disc 170 includes aperture 172, though any other standard geometrical shape such as a rectangle, oval, triangle, or an irregular shape may be substituted for the cylindrical shape depicted. Aperture 172 can be used to attach or secure the dehydration device 150 to the scroll compressor 10. A polymer matrix and a sorbent material are admixed to form a composite material. The composite material is shaped into an integral component for the scroll compressor 10. In such an embodiment, the composite material is formed into the selected shape by known molding techniques.

As illustrated in FIG. 6B, the dehydration device 150 is triangular in shape and includes a magnet 173 as the attachment feature to secure the dehydration device 150 within the scroll compressor 10, for example, by securing the magnet 173 to shell 12, base 20, lower bearing support 94 or any other suitable magnetic location within the compressor 10. It is also understood that a lanyard 156 or other securing component may be used to secure the dehydration device 150 in the scroll compressor 10, for example, by securing the lanyard 156 to the lower bearing support member 94.

Referring to FIG. 4, in an extrudate form, the surface area of the effective pellet relates to the rate of dehydration. As the diameter thins, the effective overall surface area rises when considering an equivalent pellet length in an equivalent mass or volume of a plurality of pellets. Also, the diameter and length of the pellet are important. For example, a pellet having a diameter of 1 millimeter and a length of 1 millimeter would provide greater dehydration efficiency than a pellet having a diameter of 2 millimeters and a length of 1 millimeter.

It must also be noted that in an extrusion process, a range of lengths and diameters will occur during conventional processing. Thus, the effective pellet ranges discussed here will be lengthened or decreased in light of standard deviations from a given process (often up to +/−20% diameter and length). In various aspects, the diameter of the pellet is from greater than or equal to about 1.5 millimeters to less than or equal to about 4 millimeters. In other aspects, the length is from greater than or equal to about 3 millimeters to less or equal to than about 6 millimeters. As one non-limiting example, a pellet would have a diameter of 2.2 millimeters and a length of 3.5 millimeters.

Turning to FIGS. 6A and 6B, to optimize exposure of the fluid with the dehydration device 150, the aspect ratio of the planar area to the thickness of the dehydration device is controlled. Modulating the thickness provides an adequately thin dehydration device 150 to maximize water removal by maximizing the surface area of the dehydration device 150. In addition, the rate of water removal can be optimized with the surface area and thickness of the dehydration device 150. Dehydration efficiency is also controlled by the number of pellets per pound or kilogram of the dehydration component.

It is understood that it is within the scope of the present teachings to use a single dehydration device 150 or to incorporate several different or similar dehydration devices 150 into a hermetically sealed system. By contacting the hygroscopic fluid with the dehydration device 150, the present teachings have alleviated the previous limitations for moisture removal and acid build-up prevention in hermetically sealed systems. The long-term effects of the dehydration devices 150 prevent more frequent and expensive replacement of the scroll compressor 10 and/or the system into which the scroll compressor 10 is incorporated. The financial, logistic, and chemical benefits of the present methods are optimized by the selection of materials and placement of the dehydration device(s) 150.

In summary, in various aspects, the present disclosure provides methods of removing moisture in a hermetically sealed system. In certain variations, the hermetically sealed system includes a compressor. The method may further include charging the hermetically sealed system with a hygroscopic fluid. Then, at least a portion of the hygroscopic fluid is contacted with a dehydration device that is located inside a compressor that is in the hermetically sealed system. The dehydration device serves to remove at least a portion of moisture present in the hermetically sealed system. In certain aspects, the methods optionally further include attaching the dehydration device to an interior of the compressor using a fastener or other securing component. The attaching of the dehydration device can be at a location inside the compressor adjacent a hygroscopic fluid collection area or adjacent a flow path for the hygroscopic fluid. In other alternative variations, the attaching can be in a region near or adjacent to the compressor in the sealed system. The contacting of the hygroscopic fluid with the dehydration device can optionally occur concurrently with the charging of the hermetically sealed system with the hygroscopic fluid.

In certain aspects, the dehydration device comprises a composite comprising a sorbent material in a polymer matrix. The composite has a first water affinity and the fluid has a second water affinity, where the first water affinity is greater than the second water affinity. In other aspects, the dehydration device comprises a composite comprising a sorbent material in a polymer matrix. The sorbent material can be selected from the group consisting of: calcium zeolites, sodium zeolites, potassium zeolites, aluminosilicates, and combinations thereof. In certain aspects, the hygroscopic fluid comprises a polyol ester oil. In certain variations, the method may further comprise disposing the dehydration device comprising a packet and a plurality of dehydration components within the compressor. After the fluid is introduced into the compressor, the packet contacts the fluid and removes at least a portion of moisture contained in the fluid by retaining the moisture in the dehydration components. In certain aspects, the method comprises passing the fluid through interstices defined between the plurality of dehydration components in the pack of the dehydration device. The dehydration device is thus capable of removing at least a portion of moisture during an operating condition of the compressor selected from on-, off-, or standby-conditions. In certain aspects, after disposing the dehydration device in the form of a packet in the compressor, the method further comprises hermetically sealing the compressor. In certain variations, removal of at least a portion of the moisture may occur concurrently with introducing the fluid in the compressor.

In other variations, a method is provided for removing moisture from a scroll compressor that is capable of circulating a hygroscopic fluid. The method optionally includes disposing a dehydration device in the form of a packet including a plurality of dehydration components within the scroll compressor. After the scroll compressor is charged with a hygroscopic fluid, the packet is capable of removing at least a portion of moisture that is contained in the hygroscopic fluid by retaining moisture in the plurality of dehydration components. In this regard, the dehydration components have a first water affinity and the hygroscopic fluid has a second water affinity, where the first water affinity is higher than the second water affinity. In such a method, the packet contacts the hygroscopic fluid and thus serves to remove at least a portion of moisture contained in the hygroscopic fluid. Such a dehydration device is optionally capable of removing at least a portion of moisture during an operating condition of the compressor selected from on-, off-, and standby-conditions. In certain variations, the packet is capable of removing moisture in the scroll compressor for a duration of at least five years.

In yet another aspect, a method of forming a compressor is provided. The method includes disposing a dehydration device an interior of a compressor that is hermetically sealed. The dehydration device is capable of and serves to remove at least a portion of moisture from a hygroscopic fluid circulated within the compressor. In certain variations, the dehydration device is created by forming a composite material including a polymer matrix and a sorbent material. In other variations, the method optionally further includes shaping the composite material into an integral component for the compressor, where the integral component is incorporated into the compressor. Such an integral component is optionally capable of removing at least a portion of moisture during an operating condition of the compressor selected from on-, off-, and standby-conditions. In certain variations, after disposing the dehydration device in the compressor, the compressor is hermetically sealed.

In still other embodiments, methods of forming a component for a scroll compressor are provided. A composite material including a polymer matrix and a sorbent material is shaped into an integral component for a scroll compressor. In various aspects, the method optionally includes incorporating the integral component into the scroll compressor. The method further optionally includes hermetically sealing the scroll compressor. In further various aspects, the method optionally includes removing moisture from the scroll compressor during operation by retaining at least a portion of the moisture in the sorbent material. In certain variations, removal of at least a portion of the moisture occurs concurrently with charging the scroll compressor with the hygroscopic fluid. In other variations, the integral component is capable of removing at least a portion of moisture during an operating condition of the scroll compressor selected from on-, off-, and standby-conditions.

Those skilled in the art can now appreciate from the foregoing discussion that the broad teachings of the present disclosure can be implemented in a variety of forms. It should be appreciated that the foregoing description of the present teachings is merely exemplary in nature and, thus, variations that do not depart from the gist of the teachings are intended to be within the scope of the teachings. Such variations are not to be regarded as a departure from the spirit and scope of the teachings.

What is claimed:

1. A method of removing moisture in a sealed system comprising a compressor comprising:

a. introducing a fluid comprising a refrigerant and a lubricant oil into the sealed system comprising the compressor; and b. contacting the fluid with a dehydration device located inside or disposed near the compressor in the sealed system to remove a portion of moisture from the fluid within the sealed system, wherein the dehydration device comprises a composite comprising a sorbent material in a polymer matrix, wherein the composite has a first water affinity and the fluid has a second water affinity, wherein the first water affinity is greater than the second water affinity.

2. The method of claim 1, further comprising attaching the dehydration device to an interior of the compressor using a fastener.

3. The method of claim 2, further comprising attaching the dehydration device at a location inside the compressor adjacent a fluid collection area or adjacent a flow path for the fluid.

4. The method of claim 1, wherein the contacting the fluid with the dehydration device occurs concurrently with the introducing the fluid into the sealed system.

5. The method of claim 1, wherein the sorbent material is selected from the group consisting of: calcium zeolites, sodium zeolites, potassium zeolites, aluminosilicates, and combinations thereof.

6. The method of claim 1, wherein the lubricant oil comprises a polyol ester oil.

7. The method of claim 1, further comprising disposing the dehydration device comprising a packet and a plurality of dehydration components within the compressor, so that after the introducing the fluid into the sealed system comprising the compressor, the packet contacts the fluid and removes at least a portion of moisture contained in the fluid by retaining the moisture in the dehydration components.

8. The method of claim 7, further comprising mounting the packet on a component inside the compressor.

9. The method of claim 7, further comprising passing the fluid through interstices defined between the plurality of dehydration components in the packet of the dehydration device.

10. The method of claim 7, wherein the dehydration device is capable of removing at least a portion of moisture during an operating condition of the compressor selected from on-, off-, or standby-conditions.

11. The method of claim 7, further comprising hermetically sealing the compressor after the disposing the packet in the compressor.

12. The method of claim 7, wherein removal of at least a portion of the moisture occurs concurrently with introducing the fluid into the sealed system comprising the compressor.

13. A method of forming a compressor comprising:

forming a dehydration device by forming a composite material comprising a polymer matrix and a sorbent material; and disposing the dehydration device on an interior of the compressor, wherein the dehydration device is capable of removing at least a portion of moisture from a fluid comprising a refrigerant and a lubricant oil circulated within the compressor.

14. The method of claim 13, wherein the forming further comprises shaping the composite material into an integral component for the compressor and incorporating the integral component into the compressor.

15. The method of claim 14, wherein the integral component is capable of removing at least a portion of moisture during an operating condition of the compressor selected from on-, off-, or standby-conditions.

16. The method of claim 1, further comprising removing moisture from the compressor during operation by retaining at least a portion of the moisture in the sorbent material of the dehydration device, wherein the dehydration device has a first water affinity and the fluid has a second water affinity, wherein the first water affinity is higher than the second water affinity.

17. A method of forming a component for a scroll compressor comprising:

shaping a composite material comprising a polymer matrix and a sorbent material into an integral component for the scroll compressor capable of removing moisture from a hygroscopic fluid comprising a refrigerant and a lubricant oil processed in the scroll compressor.

18. The method of claim 17, further comprising incorporating the integral component into the scroll compressor.

19. The method of claim 17, further comprising hermetically sealing the scroll compressor.

20. The method of claim 17, further comprising removing moisture from the scroll compressor by retaining at least a portion of the moisture in the sorbent material.

21. The method of claim 20, wherein the integral component is capable of removing at least a portion of the moisture during an operating condition of the scroll compressor selected from on-, off-, or standby-conditions.

* * * * *